US008616655B2

(12) United States Patent
Jung

(10) Patent No.: US 8,616,655 B2
(45) Date of Patent: Dec. 31, 2013

(54) ASSEMBLY OF MESH CUSHION IN A MESH CHAIR AND ASSEMBLING METHOD THEREOF

(75) Inventor: Kwan-Young Jung, Goyang-si (KR)

(73) Assignee: Duoback Korea Co., Ltd., Incheon (KR)

( * ) Notice: Subject to any disclaimer, the term of this patent is extended or adjusted under 35 U.S.C. 154(b) by 141 days.

(21) Appl. No.: 13/119,283

(22) PCT Filed: Sep. 19, 2008

(86) PCT No.: PCT/KR2008/005553

§ 371 (c)(1),
(2), (4) Date: Mar. 16, 2011

(87) PCT Pub. No.: WO2010/032889

PCT Pub. Date: Mar. 25, 2010

(65) Prior Publication Data

US 2011/0169321 A1 Jul. 14, 2011

(51) Int. Cl.
*A47C 7/02* (2006.01)

(52) U.S. Cl.
USPC ..... 297/452.56

(58) Field of Classification Search
USPC ..... 297/452.13, 452.56
See application file for complete search history.

(56) References Cited

U.S. PATENT DOCUMENTS

| | | | | |
|---|---|---|---|---|
| 4,062,589 | A | 12/1977 | Klein et al. | |
| 6,550,866 | B1 * | 4/2003 | Su | 297/452.42 |
| 6,942,300 | B2 * | 9/2005 | Numa et al. | 297/452.56 |
| 7,066,550 | B1 * | 6/2006 | Su | 297/440.22 |
| 7,152,929 | B2 * | 12/2006 | Wu | 297/452.56 |
| 7,669,925 | B2 * | 3/2010 | Beck et al. | 297/218.3 |
| 2004/0124689 | A1 | 7/2004 | Numa et al. | |
| 2007/0267911 | A1 * | 11/2007 | Kinoshita et al. | 297/452.18 |

FOREIGN PATENT DOCUMENTS

| | | |
|---|---|---|
| KR | 10-2004-0016170 | 2/2004 |
| KR | 10-2005-0037556 | 4/2005 |
| KR | 10-2006-0087335 | 8/2006 |

OTHER PUBLICATIONS

Korean Intellectual Property Office, International Search Report for International Application No. PCT/KR2008/005553, Jun. 11, 2009.
Korean Intellectual Property Office, Written Opinion of the International Searching Authority for International Application No. PCT/KR2008/005553, Jun. 11, 2009.

* cited by examiner

*Primary Examiner* — David Dunn
*Assistant Examiner* — Timothy J Brindley
(74) *Attorney, Agent, or Firm* — Sherr & Jiang, PLLC

(57) ABSTRACT

In an assembly of a mesh cushion in a mesh chair and an assembling method thereof, a mesh member can be strongly fixed to a frame, enough tension can be provided to the mesh member with a simple scheme, and the edge of the mesh member can be prevented from being worn away, since the mesh type cushion assembly of a chair includes: a mesh member; a middle member fixing the edge of the mesh member; a frame and a cover that are assembled with each other so as to fix the middle member to between the frame and the cover; a tension part disposed between the frame and the cover so as to provide the mesh member with tension when the frame and the cover are assembled with each other; and a coupling unit coupling the frame and the cover to each other, and wherein, the mesh member is positioned between the frame and the cover.

20 Claims, 3 Drawing Sheets

ASSEMBLY OF MESH CUSHION IN A MESH CHAIR AND ASSEMBLING METHOD THEREOF

CROSS REFERENCE TO PRIOR APPLICATIONS

This application is a National Stage Patent Application of PCT International Patent Application No. PCT/KR2008/005553 (filed on Sep. 19, 2008) under 35 U.S.C. §371, which is hereby incorporated by reference in its entirety.

TECHNICAL FIELD

The present invention relates to a mesh chair. More particularly, the present invention relates to an assembly of a mesh cushion in a mesh chair and an assembling method thereof having advantages of strongly fixing a mesh member to a frame, providing enough tension to the mesh member with a simple scheme, preventing the edge of the mesh member from being worn away, and simplifying assembling processes.

BACKGROUND ART

In general, a chair includes a seat, a backrest, and a leg part that supports the seat. If a user sits on the chair, the buttocks of the user are contacted on the seat, and the back of the user is contacted on the backrest. In addition, in order to provide comfort to the user, a cushion is provided to the seat and the backrest. In particular, such a cushion is divided into a general type cushion and a mesh type cushion.

The general type cushion includes a sponge member, an outer member covering the sponge member, and a frame that supports both the outer member and the sponge member and that is coupled to the seat or the backrest. Accordingly, comfort is provided to the user through the sponge member. However, such a general type cushion may have a problem that air is not circulated by the sponge member.

The mesh type cushion includes a mesh member, and a frame that supports the mesh member and that is coupled to the seat or the backrest. Accordingly, comfort is provided to the user through the elasticity of the mesh member, and the problem of the general type cushion can be solved since air is circulated through the mesh of the mesh member as well.

Because of the advantage of the mesh type cushion, the mesh type cushion has been continuously developed.

On the other hand, in order to give tension to the mesh member, a first conventional mesh type cushion uses a scheme in which a tension member with a ring shape is fixed to the mesh member through an insert molding after the mesh member is pulled by a separate clamp. However, such a conventional art may have problems that cost and assembling time become increased since the clamp and the insert molding are separately requested as essential elements.

In addition, in order to fix the mesh member to the frame, a second conventional mesh type cushion uses a scheme in which a supporter is inserted into a key groove formed at the interior circumference of the frame, in a state that the supporter is temporarily curved after the edge of the mesh member is fixed to the supporter. However, such a conventional art may have a problem that the supporter fixing the mesh member is easily derailed from the key groove in a case that big load is applied to the mesh member.

In addition, since a third conventional mesh type cushion has a character that the mesh member is unfolded on a frame, a problem may occur that a surface of the mesh member directly contacted on a top surface of the frame is easily worn by outer friction and an outer impact, etc.

In addition, since a fourth conventional mesh type cushion has a character that a plate shape frame is positioned to a lower surface of the mesh member, a problem may occur that air is not well circulated by the plate type frame.

In addition, since a fifth conventional mesh type cushion has a character that a bolt is directly coupled to the mesh member, a problem may occur that the mesh member is easily torn by a load, which is applied to the mesh member.

The above information disclosed in this Background section is only for enhancement of understanding of the background of the invention and therefore it may contain information that does not form the prior art that is already known in this country to a person of ordinary skill in the art.

DISCLOSURE OF INVENTION

Technical Problem

The present invention has been made in an effort to provide an assembly of a mesh cushion in a mesh chair and an assembling method thereof having advantages of strongly fixing a mesh member to a frame, providing enough tension to the mesh member with a simple scheme, and preventing the edge of the mesh member from being worn away.

The present invention has another advantage of simplifying assembling processes.

Technical Solution

An assembly of a mesh cushion in a mesh chair according to an embodiment of the present invention includes a mesh member; a middle member fixing the edge of the mesh member; a frame and a cover that are assembled with each other so as to fix the middle member to between the frame and the cover; a tension part disposed between the frame and the cover so as to provide the mesh member with tension when the frame and the cover are assembled with each other; and a coupling unit coupling the frame and the cover to each other, and wherein the mesh member is positioned between the frame and the cover.

In addition, the tension part may include: a groove portion that is formed to the cover facing the frame; and a projection portion that is formed to the frame facing the cover so as to be inserted in the groove portion, and wherein the mesh member is pushed while the projection portion is being inserted into the groove portion, and thereby the mesh member is tightly tensioned.

In addition, the groove portion may be opened toward a center of the cover so as to become a part of an interior circumference of the cover; and the mesh member may be supported to a top end of the projection portion.

In addition, width of the projection portion may become gradually reduced as it goes toward the top end of the projection portion; and a surface of the groove portion facing the projection portion and a surface of the projection portion facing the groove portion may have almost the same tilt angle with respect to the ground.

In addition, a top portion of the interior circumference of the cover may be extended toward the center of the cover by a predetermined length, the top portion positioned over the top end of the projection portion.

In addition, the assembly of the mesh cushion in a chair according to the embodiment of the present invention may further include a position setting unit for previously positioning the middle member on the cover before the middle member is fixed to between the cover and the frame.

In addition, the position setting unit may include: an insertion protrusion formed on a surface of the middle member facing the cover; and an insertion groove formed on a surface of the cover facing the middle member such that the insertion protrusion is inserted therein.

In addition, the coupling unit may include: a first through hole formed to the frame; a second through hole formed to the middle member in correspondence to the first through hole; a screw groove formed to the cover in correspondence to the second through hole; and a bolt coupled to the first through hole, the second through hole, and the screw groove in this order.

In addition, the mesh member may be disposed apart from the second through hole by a predetermined distance and may be fixed to the middle member.

In addition, the second through hole may be formed to the insertion protrusion of the middle member.

In addition, the mesh member may be fixed to a surface of the middle member facing the cover.

In addition, the edge of the mesh member may be fixed to the middle member by needlework.

In addition, each of the cover, the middle member, and the frame may have a ring type.

As one example, the frame may be mounted to a seat supporter.

As another example, the frame may be mounted to a backrest supporter.

An assembling method of an assembly of a mesh cushion according to an embodiment of the present invention includes: a first step of fixing the edge of a mesh member to a middle member; a second step of inserting an insertion protrusion formed to the middle member into an insertion groove formed to a cover; a third step of inserting an projection portion formed to a frame into an groove portion formed to the cover; and a fourth step of coupling the cover to the frame, and wherein during performing the third step, the mesh member is pushed by the projection portion, and thereby the mesh member is tightly tensioned.

In addition, in the first step, the edge of the mesh member may be fixed to the middle member by needlework.

In addition, in the fourth step, a bolt may be coupled to a first through hole formed to the frame, a second through hole formed to the middle member, and a screw groove formed to the cover, in this order.

In addition, the mesh member may be disposed apart from the second through hole by a predetermined distance and may be sewn to the middle member by needlework.

As one example, after the fourth step, the frame may be mounted to a seat supporter.

As another example, after the fourth step, the frame may be mounted to a backrest supporter.

Advantageous Effects

As has been explained, the assembly of a mesh cushion in a chair and the assembling method thereof according to the embodiments of the present invention may have the following advantages.

According to the embodiments of the present invention, the mesh member can be strongly fixed to the frame by the coupling unit.

In addition, according to the embodiments of the present invention, enough tension can be provided to the mesh member by the projection portion and the groove portion.

In addition, according to the embodiments of the present invention, since the mesh member is positioned to between the cover and the frame, the edge of the mesh member can be prevented from outer friction.

In addition, according to the embodiments of the present invention, since a clamp and an insert molding are not used separately, the assembling processes can become simplified.

MODE FOR THE INVENTION

An exemplary embodiment of the present invention will hereinafter be described in detail with reference to the accompanying drawings. With reference to the accompanying drawings, the present invention will be described in order for those skilled in the art to be able to implement the invention. As those skilled in the art would realize, the described embodiments may be modified in various different ways, all without departing from the spirit or scope of the present invention. In addition, an assembly of a mesh cushion in a mesh chair according to an embodiment and another embodiment of the present invention explained below will be mounted to a backrest supporter or/and a seat supporter. If mounted to the seat supporter, the mesh cushion assembly supports the buttocks of a user, and if mounted to the backrest supporter, the mesh cushion assembly supports the back of the user.

Figure 1:
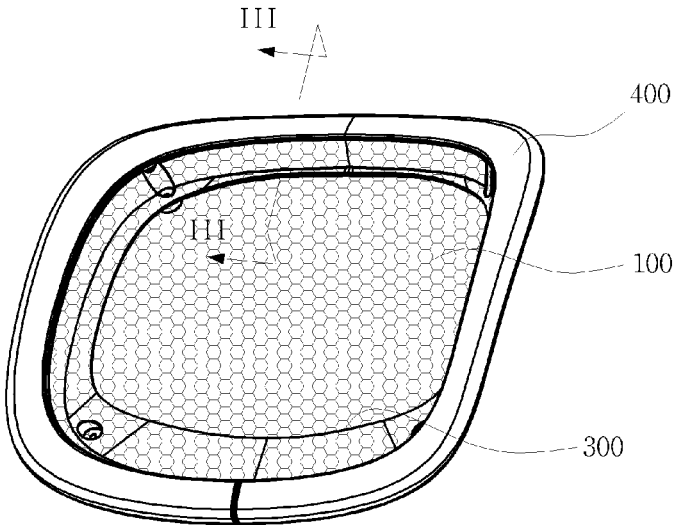
FIG. 1 is a perspective view showing an assembly of a mesh cushion in a mesh chair according to an embodiment of the present invention.
Figure 2:
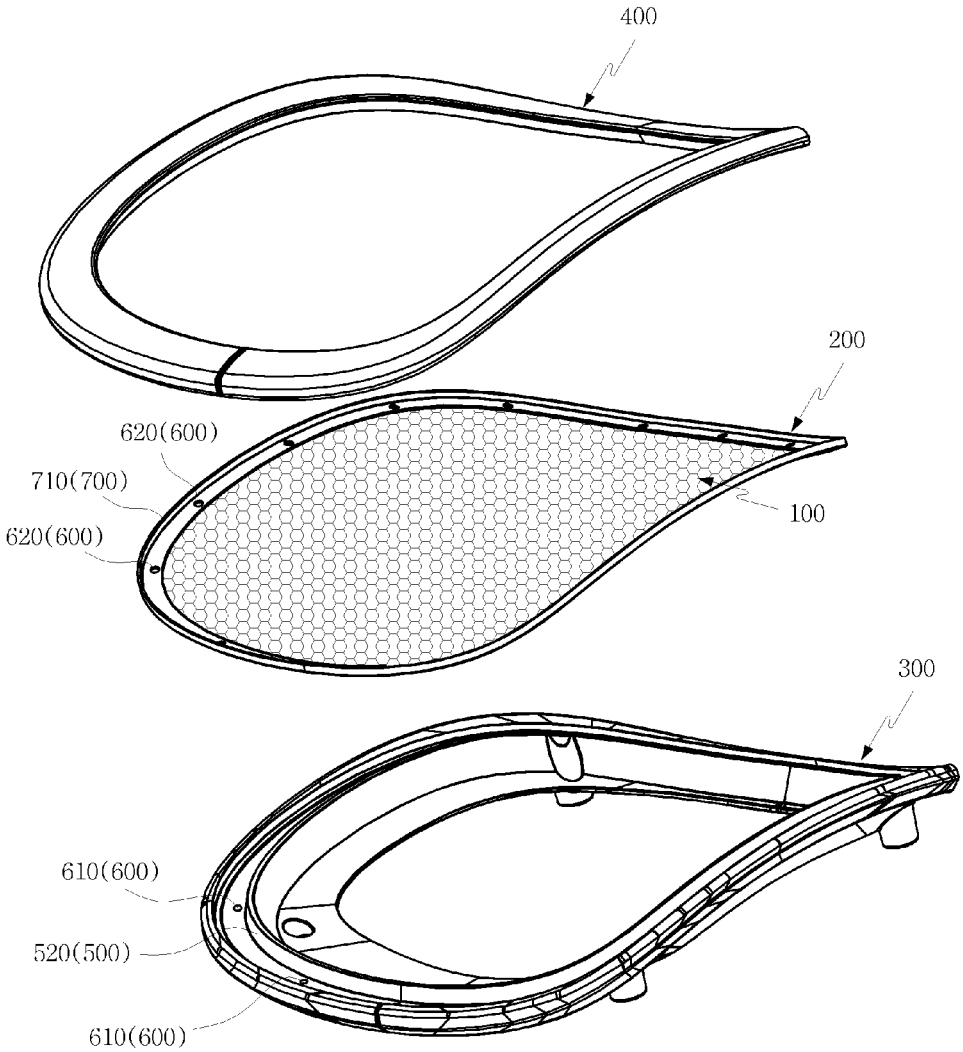
FIG. 2 is an exploded perspective view showing the assembly of the mesh cushion in a mesh chair according to the embodiment of the present invention.
Figure 3:
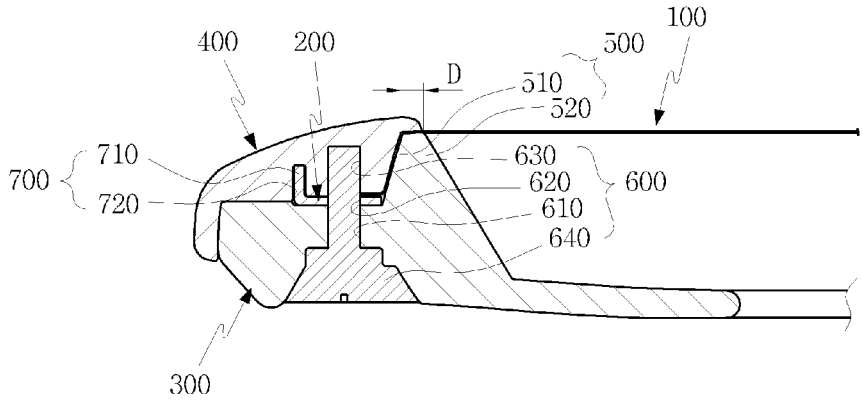
FIG. 3 is a cross-sectional view taken along the line III-III in FIG. 1 and shows a key part of the assembly of a mesh cushion in a mesh chair according to the embodiment of the present invention.

FIG. 1 is a perspective view showing an assembly of a mesh cushion in a mesh chair according to an embodiment of the present invention, FIG. 2 is an exploded perspective view showing the assembly of the mesh cushion in a mesh chair according to the embodiment of the present invention, and FIG. 3 is a cross-sectional view taken along the line III-III in FIG. 1 and shows a key part of the assembly of the mesh cushion in a mesh chair according to the embodiment of the present invention.

As shown in FIGS. 1 to 3, the assembly of the mesh cushion in a chair according to the embodiment of the present invention includes a mesh member 100, a middle member 200, a frame 300, a cover 400, a tension part 500, and a coupling unit 600.

The mesh member 100 is a place on which either of the buttocks or the back of a user is contacted, the edge of the mesh member 100 is fixed to the middle member 200 with a ring shape, and the mesh member is positioned between the frame 300 and the cover 400 such that the edge of the mesh member 100 can be prevented from outer friction or an outer impact, etc.

In addition, the edge of the mesh member 100 may be fixed to the middle member 200 by needlework. Furthermore, the mesh member 100 is sewn to the middle member 200 without being tensioned. The reason why the mesh member 100 does not required to be tensioned when the mesh member 100 is sewn to the middle member 200 is that the mesh member 100 is tensioned by the tension part 500 when the frame 300 and the cover 400 are assembled with each other as will be explained below. Consequently, since the assembly of a mesh cushion in a mesh chair according to the examination of the present invention does not require a clamp (not shown) and an insert molding (not shown) like the conventional art so as to fix the mesh member 100 to the middle member 200, the present invention can be more improved than the convention art in terms of cost. On the other hand, the middle member 100 may be formed of a resin material so as for the mesh member 100 to be easily sewn to the middle member 100.

In addition, if the frame 300 and the cover 400 are assembled with each other after the middle member 200 is positioned between the frame 300 and the cover 400, the middle member 200 to which the mesh member 100 is sewn is fixed to between the frame 300 and the cover 400.

In addition, the middle 200, the frame 300, and the cover 400 have respectively a ring shape. In particular, if the frame has the ring shape, air may be well circulated through the center of the frame 300.

With reference to FIG. 3, the above-mentioned tension part 500 will hereinafter be described in detail.

The tension part 500 is disposed between the frame 300 and the cover 400, and is to provide the mesh member 100 with tension when the frame 300 and the cover 400 are assembled with each other. As one example, the tension part 500 may include a groove portion 510 formed to one surface of the cover 400 facing the frame 300, and a projection portion 520 formed to one surface of the frame 300 facing the cover so as to be inserted in the groove portion 510. Accordingly, the mesh member 100 is pushed and is tightly tensioned by the projection portion 520 while the projection portion 520 is being inserted into the groove portion 510 (refer to FIGS. 6 and 7).

In addition, the groove portion 510 may be opened toward a center of the cover 400 so as to become a part of an interior circumference of the cover 400, and the mesh member 100 may be supported to a top end of the projection portion 520. Thereby, since the mesh member 100 can be spread out from the interior circumference of the cover 400 in a state that the mesh member is supported to the top end of the projection portion 520, a step height of between the mesh member 100 and the cover 400 may become minimized. Consequently, the buttocks or the back of the user can be comfortably rested on the mesh member 100.

In addition, width of the projection portion 520 becomes gradually reduced as it goes toward the top end of the projection portion 520, and a surface of the groove portion 510 facing the projection portion 520, and a surface of the projection portion 520 facing the groove portion 510 have almost the same tilt angle with respect to the ground. Thereby, since a bended extent of the mesh member is reduced, a phenomenon may be prevented that the mesh member become torn by the groove portion 510 of the cover 400 and the projection portion 520 of the frame 300 when the frame 300 and the cover 400 are assembled with each other, and the mesh member 100 may be more smoothly tensioned as well.

In addition, a top portion of the interior circumference of the cover 400 may be extended toward the center of the cover 400 by a predetermined length D, the top portion positioned over the top end of the projection portion 520. Accordingly, a surface of the mesh member 100 that is directly contacted on the projection portion 520 may be prevented from the outer friction by the cover 400, and a phenomenon may be minimized that a foreign substance be flowed in between the mesh member 100 and the cover 400 by gravity as well.

With reference to FIG. 3, the above-mentioned coupling unit 600 will hereinafter be described in detail.

The coupling unit 600 is to couple the frame 300 and the cover 400 with each other. As one example, the coupling unit 600 may include a first through hole 610 formed to the frame 300, a second through hole 620 formed to the middle member 200 in correspondence to the first through hole 610, a screw groove 630 formed to the cover 400 in correspondence to the second through hole 620, and a bolt coupled to the first through hole 610, the second through hole 620, and the screw groove 630 in this order. Accordingly, the frame 300, the middle member 200, and the cover 400 are strongly coupled with each other through the following assembling processes: the second through hole 620 of the middle member 200 is positioned to the first through hole 610 of the frame 300; the screw groove 630 of the cover 400 is positioned to the second through hole 620 of the middle member 200; and the bolt 640 is sequentially coupled to the first through hole 610, the second through hole 620, and the screw groove 630.

In addition, the above-mentioned mesh member 100 may be disposed apart from the second through hole 620 by a predetermined distance and fixed to the middle member 200. Thereby, the mesh member 100 can be prevented from being pull or being torn by the bolt 640 when the bolt 640 passes through the second through hole 620. However, if the mesh member 100 closes the second through hole 620, while the bolt 640 is being inserted into the second through hole 620, the mesh member 100 is pull by the bolt, and accordingly, deformation may occur in the center part of the mesh member, which has already tensioned by the tension part 500.

In addition, as shown in FIG. 3, the assembly of the mesh cushion in a mesh chair according to the embodiment of the present invention may further include a position setting unit 700 that previously positions the middle member 200 to the cover 400 before the middle member 200 is fixed to between the cover 400 and frame 300. With reference to FIG. 3, the position setting unit 700 will hereinafter be described in detail.

The position setting unit 700 may include an insertion protrusion 710 formed on a surface of the middle member 200 facing the cover 400, and an insertion groove 720 formed on a surface of the cover 400 facing the middle member 200 such that the insertion protrusion 710 is inserted therein. Accordingly, since a position of the middle member 200 can be previously set by inserting the insertion protrusion 710 into the insertion groove 720 before the middle member 200 is fixed to between the cover 400 and the frame 300, the middle member 200 can be prevented from being derailed from between the cover 400 and the frame 300 when cover 400 and the frame 300 are assembled with each other.

In addition, it is preferable that the above-mentioned mesh member 100 is sewn to a surface of the middle member 200 facing the cover 400 by needlework, and that a surface of the cover 400 facing the middle member 200 is formed to a higher position than the lower surface of the cover 400 by the sum of thick of the mesh member 100 and thick made by the needlework. Accordingly, since the frame 300 and the middle member 200 are surface-contracted on each other when the frame 300 and the cover 400 are assembled with each other, the frame 300 and the middle member 200 can be precisely assembled with each other. Consequently, the badness due to an assemble tolerance can become minimized.

In addition, as one example, the above-mentioned frame 300 may be mounted to a seat supporter (not shown). Accordingly, the buttocks of the user can be comfortably rested on the mesh member 100. In addition, as other example, the above-mentioned frame 300 may be mounted to a backrest supporter (not shown). Accordingly, the back of the user can be comfortably rested on the mesh member 100.

With reference to FIGS. 4 to 7, an assembling method of the assembly of the mesh cushion in a mesh chair according to the embodiment of the present invention will hereinafter be described in detail.

FIGS. 4 to 7 show assembling processes of the assembly of the mesh cushion in a mesh chair according to the embodiment of the present invention.

First, the edge of the mesh member 100 is fixed to the middle member 200. As one example, the edge of the mesh member 100 is sewn to the middle member 200 by the needlework.

Figure 4:
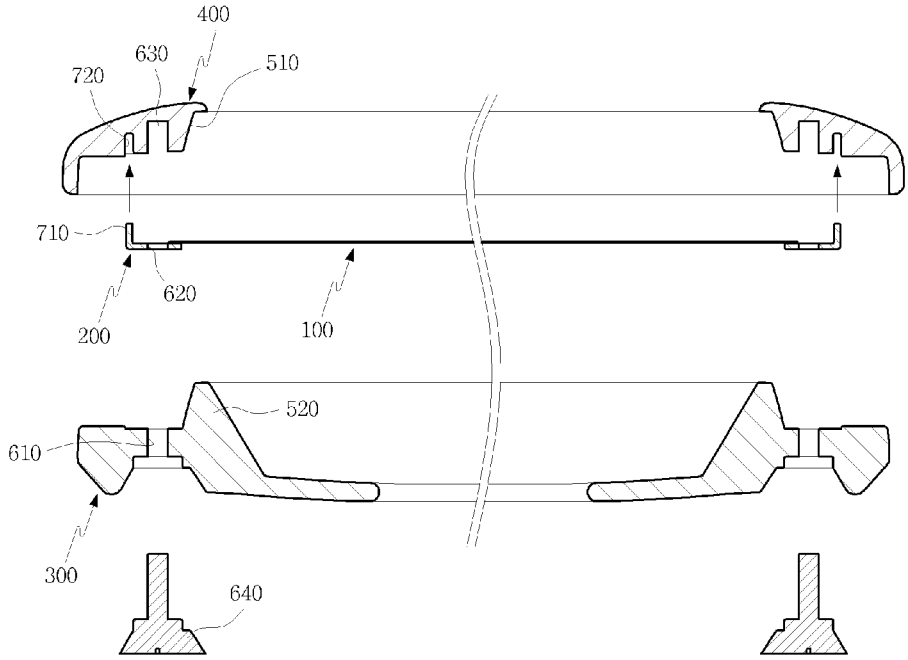
FIGS. 4 to 7 show assembling processes of the assembly of the mesh cushion in a mesh chair according to the embodiment of the present invention.

Thereafter, in order to previously set a position of the middle member 200 to a corresponding position of the cover 400, as shown in FIG. 4, the insertion protrusion 710 formed to the middle member 200 is inserted into the insertion groove 720 formed to the cover 400 along the arrow direction.

Figure 5:
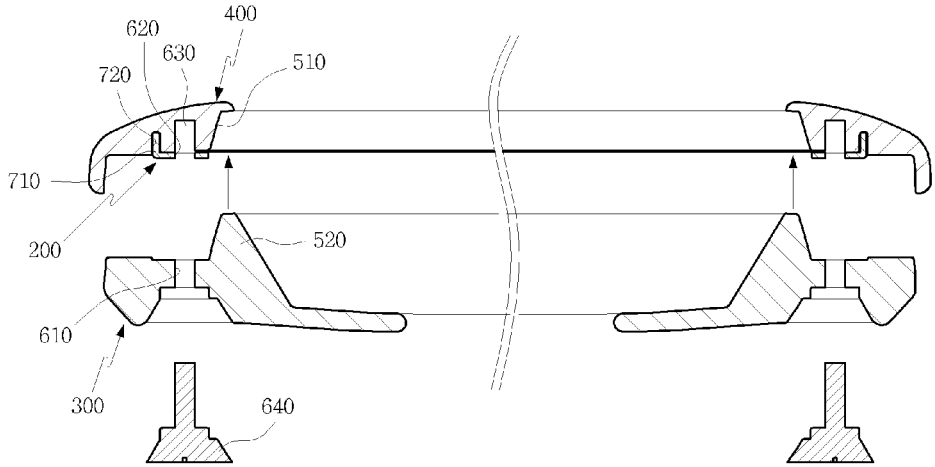
Figure 6:
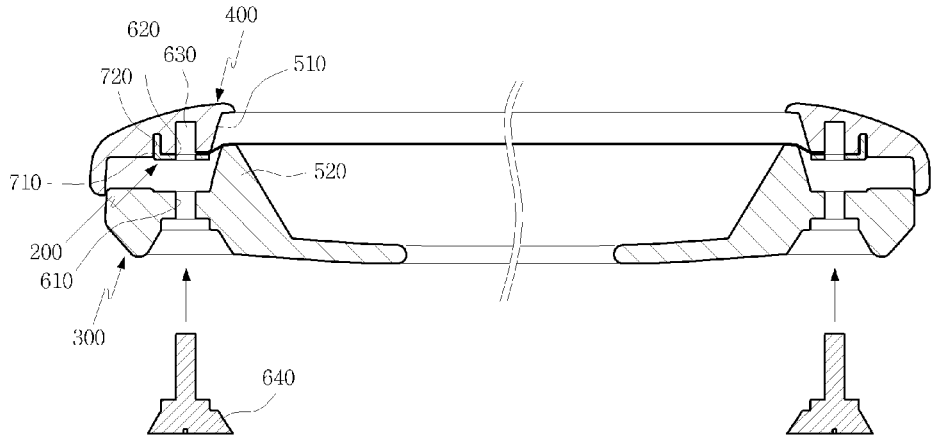

As shown in FIG. 5, if the position of the middle member 200 has been set, the projection portion 520 formed to the frame 300 is inserted into the groove portion 510 formed to the cover 510 along the arrow direction. In particular, as shown in FIGS. 6 and 7, while the projection portion 520 is being inserted into the groove portion 510, the mesh member 520 is pushed and is tightly tensioned by the projection portion 520, and the mesh member 520 is positioned to between the cover 400 and the frame 300.

Figure 7:
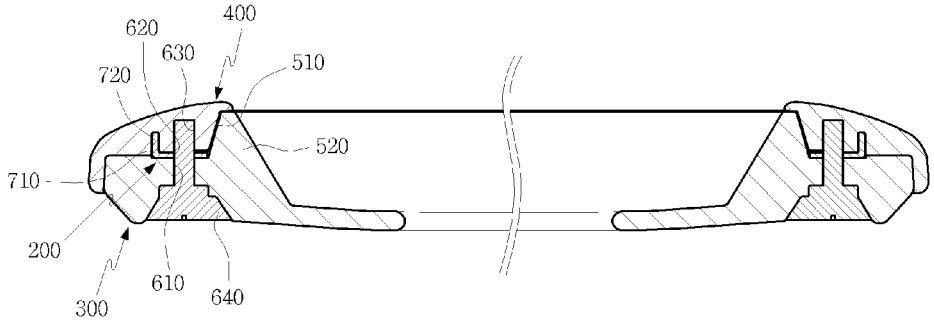

Thereafter, as shown in FIG. 7, the cover 400 is coupled to the frame 300. As one example, the cover 400 may be coupled to the frame by the bolt 640, which is inserted into the first through hole 610 formed to the frame 300, the second through hole 620 formed to the middle member 200, and the screw groove 630 formed to the cover 400 in order.

Although not shown, If the cover 400 is couple to the frame 300, the frame 300 may be mounted to the seat supporter (not shown). In addition, as other example, the frame 300 may be mounted to the backrest supporter (not shown).

Figure 8:
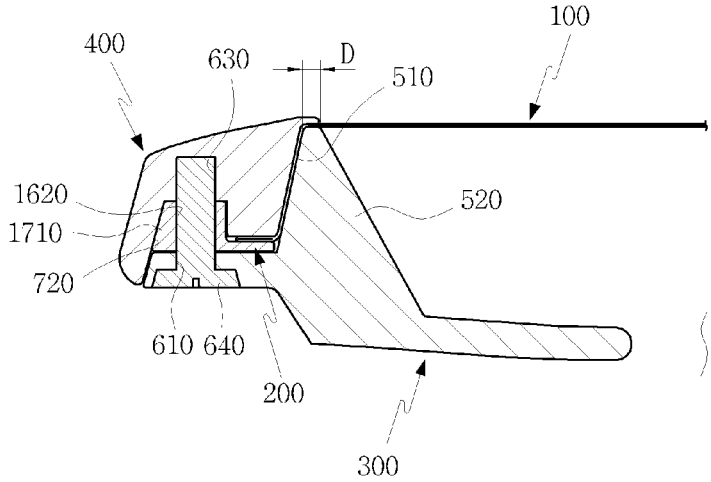
FIG. 8 is a cross-sectional view showing a key part of an assembly of a mesh cushion in a mesh chair according to another embodiment of the present invention.

On the other hand, an assembly of a mesh cushion in a mesh chair according to another embodiment of the present invention, as shown in FIG. 8, is substantially same as above-mentioned assembly of the mesh cushion in a mesh chair according to the embodiment of the present invention except a second through hole 1620 and an insertion protrusion 1710, and accordingly, the second through hole 1620 and the insertion protrusion 1710 will hereinafter be described in detail.

FIG. 8 is a cross-sectional view showing a key part of an assembly of a mesh cushion in a mesh chair according to another embodiment of the present invention.

The insertion protrusion 1710 of the middle member 200 has a lager width than the second through hole 1620, and the second trough hole 1620 is formed to the insertion protrusion 1710. Accordingly, since the insertion protrusion 1710 and the second through hole 1620 are formed to the same position, the edge of the mesh member 100 may be not positioned to the second through hole 1620 by the insertion protrusion 1710. Thereby, it may be prevented that the bolt 640 directly passes through the mesh member 100. Furthermore, since the insertion protrusion 1710 and the second through hole 1620 are integrated into the one position, a space of the middle member 200 to which the mesh member 100 is fixed may be enlarged. Thereby, a fixation of the mesh member 100 may become easier.

As has been explained, the assembly of a mesh cushion in a mesh chair and the assembling method thereof according to the embodiments of the present invention may have the following advantages.

According to the embodiments of the present invention, the mesh member can be strongly fixed to the frame by the coupling unit.

In addition, according to the embodiments of the present invention, enough tension can be provided to the mesh member by the projection portion and the groove portion.

In addition, according to the embodiments of the present invention, since the mesh member is positioned to between the cover and the frame, the edge of the mesh member can be prevented from outer friction.

In addition, according to the embodiments of the present invention, since a clamp and an insert molding are not used separately, the assembling processes can become simplified.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. An assembly of a mesh cushion in a mesh chair, comprising:

a mesh member;

a middle member having a closed loop shape, the middle member surrounding and fixing the edge of the mesh member;

a cover to which the middle member is fixed;

a frame which is assembled with the cover by a coupling unit while the middle member is interposed between the cover and the frame, wherein the coupling unit includes a bolt which penetrates the frame and the middle member and is inserted into the cover; and a tension part disposed between the frame and the cover, wherein the tension part comprises:

a groove portion that is formed on the cover facing the frame, wherein the groove portion is opened toward a center of the cover so as to become a part of an interior circumference of the cover; and a projection portion that is formed on the frame facing the cover, wherein a top end of the projection portion upwardly pushes and supports a portion of the mesh member so that the mesh member is directly suspended on the projection portion with tight tension when the projection portion is inserted in the groove portion while the frame and the cover are assembled with each other.

2. The assembly of claim 1, wherein:

the width of the projection portion becomes gradually reduced as it goes toward the top end of the projection portion; and the surface of the groove portion facing the projection portion and the surface of the projection portion facing the groove portion have almost the same tilt angle with respect to the ground.

3. The assembly of claim 2, wherein a top portion of the interior circumference of the cover positioned over the top end of the projection portion is extended toward the center of the cover by a predetermined length.

4. The assembly of claim 3, further comprising a position setting unit for previously positioning the middle member on the cover before the middle member is fixed to between the cover and the frame.

5. The assembly of claim 4, wherein the position setting unit comprises:

an insertion protrusion formed on a surface of the middle member facing the cover; and an insertion groove formed on a surface of the cover facing the middle member such that the insertion protrusion is inserted therein.

6. The assembly of claim 5, wherein the coupling unit comprises:

a first through hole formed to the frame;

a second through hole formed to the middle member in correspondence to the first through hole;

a screw groove formed to the cover in correspondence to the second through hole; and the bolt coupled to the first through hole, the second through hole, and the screw groove in this order.

7. The assembly of claim 6, wherein the mesh member is fixed to the middle member with being disposed apart from the second through hole by a predetermined distance.

8. The assembly of claim 7, wherein the second through hole is formed to the insertion protrusion of the middle member.

9. The assembly of claim 1, wherein the mesh member is fixed to a surface of the middle member facing the cover.

10. The assembly of claim 8, wherein the mesh member is fixed to a surface of the middle member facing the cover.

11. The assembly of claim 1, wherein the edge of the mesh member is fixed to the middle member by needlework.

12. The assembly of claim 1, wherein each of the cover, the middle member, and the frame has a ring type.

13. The assembly of claim 1, wherein the frame is mounted to a seat supporter.

14. The assembly of claim 1, wherein the frame is mounted to a backrest supporter.

15. An assembling method of an assembly of a mesh cushion, comprising:

a first step of fixing the edge of a mesh member to a middle member having a closed loop shape surrounding the edge of the mesh member;

a second step of inserting an insertion protrusion formed on the middle member into an insertion groove formed on a cover;

a third step of inserting a projection portion formed on a frame into an groove portion formed on the cover so that a top end of the projection portion upwardly pushes and supports a portion of the mesh member so that the mesh member is directly suspended on the projection portion with tight tension; and a fourth step of coupling the cover to the frame by a bolt while the middle member is interposed between the cover and the frame, wherein the bolt penetrates the frame and the middle member and is inserted into the cover.

16. The assembling method of claim 15, wherein, in the first step, the edge of the mesh member is fixed to the middle member by needlework.

17. The assembling method of claim 16, wherein, in the fourth step, the bolt is coupled to a first through hole formed to the frame, a second through hole formed to the middle member, and a screw groove formed to the cover, in this order.

18. The assembling method of claim 17, wherein, in the first step, the edge of the mesh member is sewn to the middle member by needlework with being disposed apart from the second through hole by a predetermined distance.

19. The assembling method of claim 15, wherein, after the fourth step, the frame is mounted to a seat supporter.

20. The assembling method of claim 15, wherein, after the fourth step, the frame is mounted to a backrest supporter.

* * * * *